US008951066B2

(12) United States Patent
Glick et al.

(10) Patent No.: US 8,951,066 B2
(45) Date of Patent: Feb. 10, 2015

(54) ELECTRICAL CONNECTOR

(75) Inventors: Michael Glick, Farmington Hills, MI (US); Cecil Lamar Brown, II, Canton, MI (US); David Menzies, Linden, MI (US); Reshma Rathod, Auburn Hills, MI (US); Brantley Natter, Brighton, MI (US); Slobodan Pavlovic, Novi, MI (US); Sheikh Habibur Rahman, Macomb, MI (US)

(73) Assignee: Lear Corporation, Southfield, MI (US)

( * ) Notice: Subject to any disclaimer, the term of this patent is extended or adjusted under 35 U.S.C. 154(b) by 243 days.

(21) Appl. No.: 13/486,373

(22) Filed: Jun. 1, 2012

(65) Prior Publication Data

US 2013/0023137 A1 Jan. 24, 2013

Related U.S. Application Data

(60) Provisional application No. 61/510,712, filed on Jul. 22, 2011.

(51) Int. Cl.
*H01R 13/40* (2006.01)
*H01R 13/426* (2006.01)

(52) U.S. Cl.
CPC ..... *H01R 13/426* (2013.01)
USPC ..... 439/595; 349/752

(58) Field of Classification Search
USPC ..... 439/595, 752, 246, 304
See application file for complete search history.

(56) References Cited

U.S. PATENT DOCUMENTS 4,319,799 A 3/1982 Pearce, Jr.
4,705,337 A * 11/1987 Maeda ..... 439/595
4,867,712 A 9/1989 Kato et al.
4,946,399 A * 8/1990 Kawashima ..... 439/752
5,108,319 A * 4/1992 Tsuji et al. ..... 439/752
5,358,427 A * 10/1994 Miwa ..... 439/595
5,474,477 A * 12/1995 Aoyama ..... 439/752
5,554,051 A 9/1996 Shinji et al.
5,820,411 A * 10/1998 Okabe ..... 439/595
5,859,534 A * 1/1999 Saijo et al. ..... 324/538
5,897,402 A * 4/1999 Sasai et al. ..... 439/752
5,967,859 A * 10/1999 Cecil et al. ..... 439/752

(Continued)

FOREIGN PATENT DOCUMENTS

CN 1238580 A 12/1999
JP 2003-100376 A 4/2003
JP 2004152583 A 5/2004

OTHER PUBLICATIONS

Machine Translation of JP 2003-100376, published Apr. 4, 2003.

(Continued)

*Primary Examiner* — Briggitte R Hammond
(74) *Attorney, Agent, or Firm* — Brooks Kushman P.C.

(57) ABSTRACT

An electrical connector includes an electrical terminal and a housing having a front end and a back end with an opening configured to receive the electrical terminal therethrough. The housing includes a first lock system configured to allow insertion of the electrical terminal into the housing and prohibit removal of the electrical terminal from the housing. The housing is configured such that the first lock system is accessible from the front of the housing to release the electrical terminal from the first lock system. A second lock system is configured for insertion into the housing to prohibit removal of the electrical terminal from the housing independently from the first lock system.

16 Claims, 4 Drawing Sheets

(56) References Cited

U.S. PATENT DOCUMENTS

| | | | | |
|---|---|---|---|---|
| 5,980,331 | A | 11/1999 | Matsushita et al. | |
| 6,146,200 | A | 11/2000 | Ito et al. | |
| 6,152,782 | A | 11/2000 | Volkert et al. | |
| 6,152,783 | A | 11/2000 | Tsuchiya | |
| 6,183,313 | B1 * | 2/2001 | Kashiyama | 439/752 |
| 6,183,314 | B1 | 2/2001 | Wada et al. | |
| 6,290,539 | B1 * | 9/2001 | Wilber et al. | 439/595 |
| 6,322,391 | B1 * | 11/2001 | Kodama | 439/595 |
| 6,354,867 | B1 * | 3/2002 | Tachi et al. | 439/488 |
| 6,425,780 | B1 | 7/2002 | Muhlmichel | |
| 6,461,203 | B2 * | 10/2002 | Todo | 439/752 |
| 6,494,781 | B2 | 12/2002 | Fujita et al. | |
| 6,524,133 | B2 | 2/2003 | Murakami | |
| 6,575,795 | B1 | 6/2003 | Kashiyama | |
| 6,595,807 | B2 | 7/2003 | Kashiyama | |
| 6,604,966 | B1 | 8/2003 | Hayes et al. | |
| 6,648,699 | B1 * | 11/2003 | Makino et al. | 439/752 |
| 6,757,259 | B1 | 6/2004 | Hamilton | |
| 6,769,934 | B2 | 8/2004 | Nakamura et al. | |
| 6,811,451 | B2 * | 11/2004 | Mase et al. | 439/752 |
| 6,835,102 | B2 | 12/2004 | Kayama | |
| 6,835,105 | B1 | 12/2004 | Nakamura et al. | |
| 6,893,277 | B2 * | 5/2005 | Parrish et al. | 439/188 |
| 6,896,560 | B2 | 5/2005 | Nakamura et al. | |
| 6,935,904 | B2 | 8/2005 | Ishiyama | |
| 7,195,522 | B2 * | 3/2007 | Okada et al. | 439/752 |
| 7,201,615 | B2 | 4/2007 | Kojima | |
| 7,204,725 | B2 | 4/2007 | Yamashita | |
| 7,204,726 | B2 | 4/2007 | Yamashita et al. | |
| 7,207,841 | B2 | 4/2007 | Machida et al. | |
| 7,223,124 | B2 | 5/2007 | Nakamura et al. | |
| 7,261,603 | B2 | 8/2007 | Takahashi et al. | |
| 7,278,883 | B2 | 10/2007 | Tyler | |
| 7,278,890 | B1 | 10/2007 | Smutny et al. | |
| 7,347,732 | B2 * | 3/2008 | Ohtaka et al. | 439/595 |
| 7,416,453 | B2 | 8/2008 | Germani | |
| 7,500,887 | B2 | 3/2009 | Ichio | |
| 7,556,538 | B2 | 7/2009 | Nakamura | |
| 7,556,539 | B2 | 7/2009 | Takahashi et al. | |
| 7,563,134 | B2 | 7/2009 | Kim | |
| 7,563,135 | B2 | 7/2009 | Takahashi et al. | |
| 7,625,251 | B2 | 12/2009 | Martin et al. | |
| 7,828,607 | B2 * | 11/2010 | Kojima | 439/752 |
| 8,052,489 | B2 | 11/2011 | Mase et al. | |
| 2001/0005657 | A1 | 6/2001 | Kashiyama | |
| 2001/0016457 | A1 | 8/2001 | Taguchi et al. | |
| 2001/0027067 | A1 | 10/2001 | Kojima et al. | |
| 2002/0013105 | A1 | 1/2002 | Kashiyama | |
| 2003/0096533 | A1 | 5/2003 | Kojima et al. | |
| 2003/0148669 | A1 | 8/2003 | Ishikawa et al. | |
| 2003/0190841 | A1 | 10/2003 | Nakamura et al. | |
| 2003/0190842 | A1 | 10/2003 | Fukatsu et al. | |
| 2004/0005821 | A1 | 1/2004 | Nankou et al. | |
| 2004/0242083 | A1 | 12/2004 | Ishiyama | |
| 2004/0253884 | A1 | 12/2004 | Sakurai et al. | |
| 2005/0112943 | A1 | 5/2005 | Sagawa et al. | |
| 2005/0124216 | A1 | 6/2005 | Sagawa et al. | |
| 2005/0170703 | A1 | 8/2005 | Nakamura | |
| 2005/0170704 | A1 | 8/2005 | Ishikawa et al. | |
| 2005/0247476 | A1 | 11/2005 | Aihara et al. | |
| 2006/0052004 | A1 | 3/2006 | Yamashita | |
| 2006/0063427 | A1 | 3/2006 | Tanaka et al. | |
| 2006/0068647 | A1 | 3/2006 | Kojima | |
| 2006/0073739 | A1 | 4/2006 | Aihara | |
| 2006/0084326 | A1 | 4/2006 | Horiuchi et al. | |
| 2006/0189219 | A1 | 8/2006 | Yamashita et al. | |
| 2007/0275609 | A1 | 11/2007 | Lamdiziz et al. | |
| 2007/0281555 | A1 | 12/2007 | Suemitsu et al. | |
| 2008/0020639 | A1 | 1/2008 | Ichio | |
| 2008/0020653 | A1 | 1/2008 | Horiuchi | |
| 2008/0305694 | A1 | 12/2008 | Takahashi et al. | |
| 2009/0081908 | A1 | 3/2009 | Martin et al. | |
| 2009/0130902 | A1 | 5/2009 | Hall et al. | |
| 2009/0247000 | A1 | 10/2009 | Shuey | |
| 2009/0269963 | A1 | 10/2009 | Brown et al. | |
| 2010/0062660 | A1 | 3/2010 | Itou et al. | |
| 2011/0223789 | A1 | 9/2011 | Sasaki et al. | |
| 2013/0023163 | A1 | 1/2013 | Glick et al. | |

OTHER PUBLICATIONS

Chinese Office Action in Application No. 201210279288.1 filed Apr. 28, 2014.

Chinese Office Action in Application No. 201210253498.3 filed Apr. 18, 2014.

* cited by examiner

ELECTRICAL CONNECTOR

CROSS-REFERENCE TO RELATED APPLICATIONS

This application claims the benefit of U.S. provisional patent application No. 61/510,712 filed on 22 Jul. 2011, which is hereby incorporated herein by reference.

TECHNICAL FIELD

The present invention relates to an electrical connector having an electrical terminal and a housing including a locking system configured to retain the electrical terminal.

BACKGROUND

Electrical connectors may have a number of design requirements depending on the their intended use. Some of these requirements include assurance of correct orientation or polarity of the terminal, minimum retention force for a terminal inside a housing, and the ability to remove a terminal and reinsert it, or insert a new terminal, into the same housing, just to name a few such requirements. Examples of electrical connectors are described in the following U.S. patents: U.S. Pat. No. 5,554,051, U.S. Pat. No. 6,425,780, U.S. Pat. No. 7,261,603 and U.S. Pat. No. 7,416,453.

SUMMARY

Embodiments of the invention include an electrical connector including an electrical terminal and a housing. The housing has a front end and a back end having an opening configured to receive the electrical terminal therethrough. The housing includes a first lock system configured to allow insertion of the electrical terminal into the housing and prohibit removal of the electrical terminal therefrom. The housing is configured such that the first lock system is accessible from the front of the housing to release the electrical terminal from the first lock system. The electrical connector also includes a second lock system configured for insertion into the housing to prohibit removal of the electrical terminal from the housing independently from the first lock system.

Embodiments of the invention include an electrical connector including an electrical terminal and a housing. The housing includes a front end and a back end including an opening therein for facilitating insertion of the electrical terminal into the housing such that the housing at least partially encloses the electrical terminal. The housing further includes a plurality of walls, a pair of locking beams having a lock position for prohibiting removal of the electrical terminal from the housing and a release position for facilitating removal of the electrical terminal from the housing, and a pair of channels accessible through the front end and disposed adjacent respective locking beams for receiving a removal tool therein to facilitate movement of the locking beams from the lock position to the release position. The electrical connector further includes a blocking member configured for insertion into the housing to block removal of the electrical terminal from the housing.

Embodiments of the invention include an electrical connector including an electrical terminal and a housing configured to at least partially enclose the electrical terminal. The housing includes a pair of locking beams cantilevered toward a front of the housing and disposed on opposite sides of the electrical terminal. The locking beams have a lock position in which the locking beams are engaged with the electrical terminal, and a release position in which the locking beams are not engaged with the electrical terminal. The housing includes a back end through which the electrical terminal is inserted into the housing, and a front end through which a mating terminal can be inserted to mate with the electrical terminal. The front end includes a pair of apertures generally aligned with the locking beams for receiving a removal tool to move the locking beams from the lock position to the release position. A lock system is configured for insertion into the housing such that a portion of the lock system is disposed between the electrical terminal and the back end, thereby prohibiting removal of the electrical terminal from the back end.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
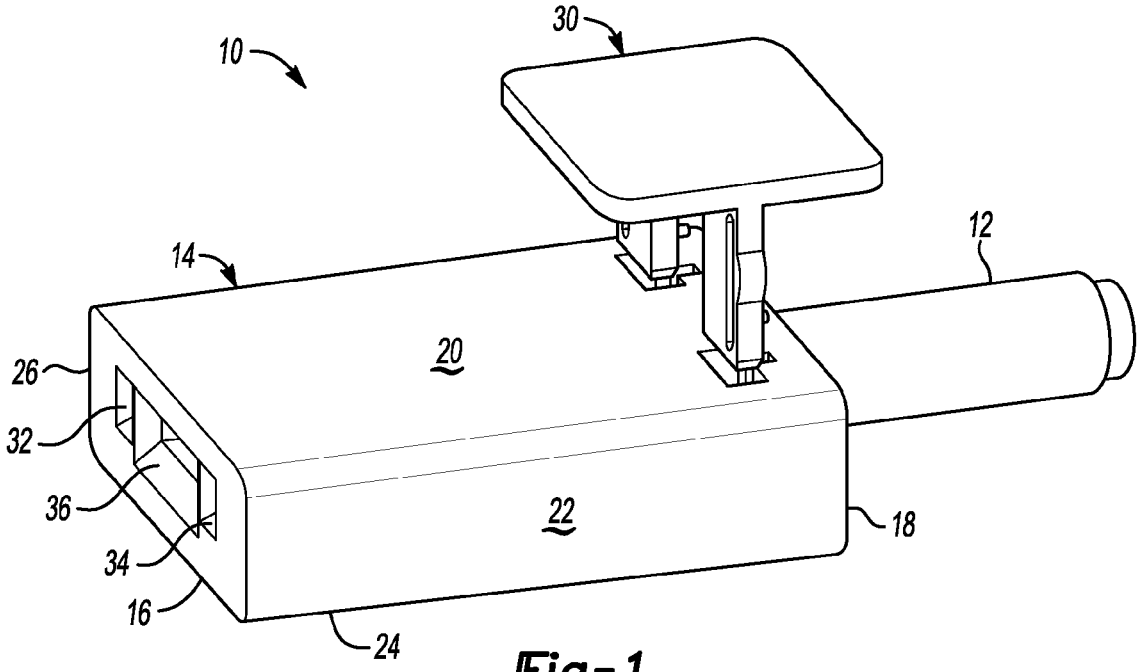
FIG. 1 is a perspective view of an electrical connector in accordance with embodiments of the present invention.

FIG. 1 shows an electrical connector 10 in accordance with embodiments of the present invention. The connector 10 includes an electrical terminal 12 in a housing 14 configured to at least partially enclose the electrical terminal 12. Each of these components is further illustrated and described in more detail below. The housing 14 includes a front end 16, a back end 18 and four walls 20, 22, 24, 26. Although the shape of the housing 14 is generally rectangular, embodiments of the invention may include housings having different shapes, which may take into account, for example, the packaging requirements of the end use.

Figure 2:
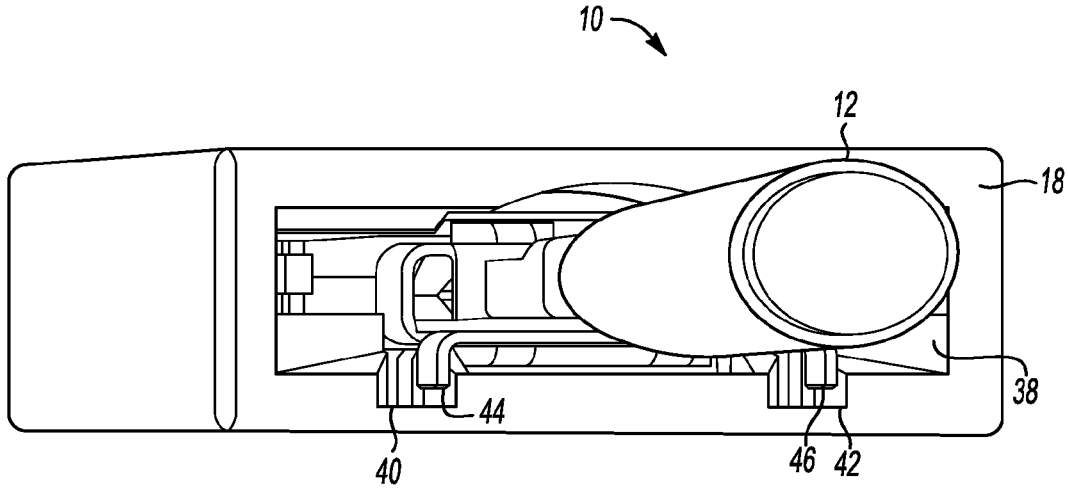
FIG. 2 is a perspective view of a back end of the electrical connector shown in FIG. 1.

The connector 10 includes a first lock system 28 (shown in FIG. 3) and a second lock system 30. The front end 16 of the housing 14 includes apertures 32, 34 and an opening 36 configured to receive a mating terminal to mate with the electrical terminal 12. FIG. 2 shows a rear-facing view of the electrical connector 10. In this view, it is shown that the housing 14 includes an opening 38 in the back end 18 through which the electrical terminal 12 can be inserted into the housing 14. The housing 14 also includes housing alignment features 40, 42, which are configured as notches in the back end 18. The electrical terminal 12 has corresponding terminal alignment features 44, 46 configured as tabs, which align with the notches 40, 42 to allow the electrical terminal 12 to be inserted into the housing 14. As shown in FIG. 2, if the electrical terminal 12 is incorrectly turned 180° prior to insertion into the housing 14, the tabs 44, 46 will hit the back end 18 such that the terminal 12 cannot be inserted into the housing 14. This feature ensures that the terminal 12 will only be inserted into the housing 14 with one orientation, and the polarity will be correct for mating terminals. Of course, polarity is not always an issue, depending on the end use, and therefore these features may not be included in embodiments of the invention.

Figure 3:
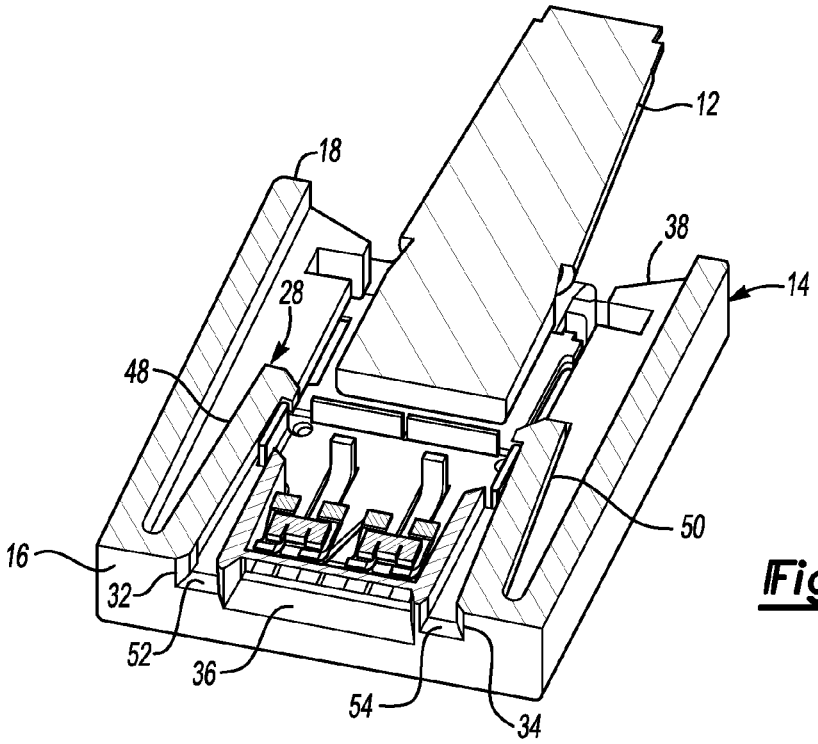
FIG. 3 is a cross-sectional view of a portion of the electrical connector shown in FIG. 1.

FIG. 3 shows the first locking system 28, which includes a pair of locking beams 48, 50. The locking beams 48, 50 are cantilevered beams, which have a cantilever attachment directed toward the front end 16 of the housing 14. As shown in FIG. 3, the locking beams 48, 50 are in a lock position, wherein they engage the electrical terminal 12 to prohibit removal of the electrical terminal 12 from the housing 14, and in particular, prohibit its removal through the opening 38 in the back end 18. As used herein, the word "prohibit" does not mean that it is impossible to remove the electrical terminal 12 from the housing 14; rather, it means that the locking beams 48, 50 maintain the electrical terminal 12 within the housing with a desired amount of retention force.

As shown in FIG. 1, the front end 16 of the housing 14 includes apertures 32, 34. As more clearly illustrated in FIG. 3, these apertures open into channels 52, 54, which are generally aligned with the locking beams 48, 50. In order to easily remove the electrical terminal 12 from the housing 14, it is necessary to move the locking beams 48, 50 from the lock position to the release position. This is illustrated in FIG. 4, where a removal tool 56 is inserted through the apertures 32, 34 in the front end 16, and into the channels 52, 54.

Figure 4:
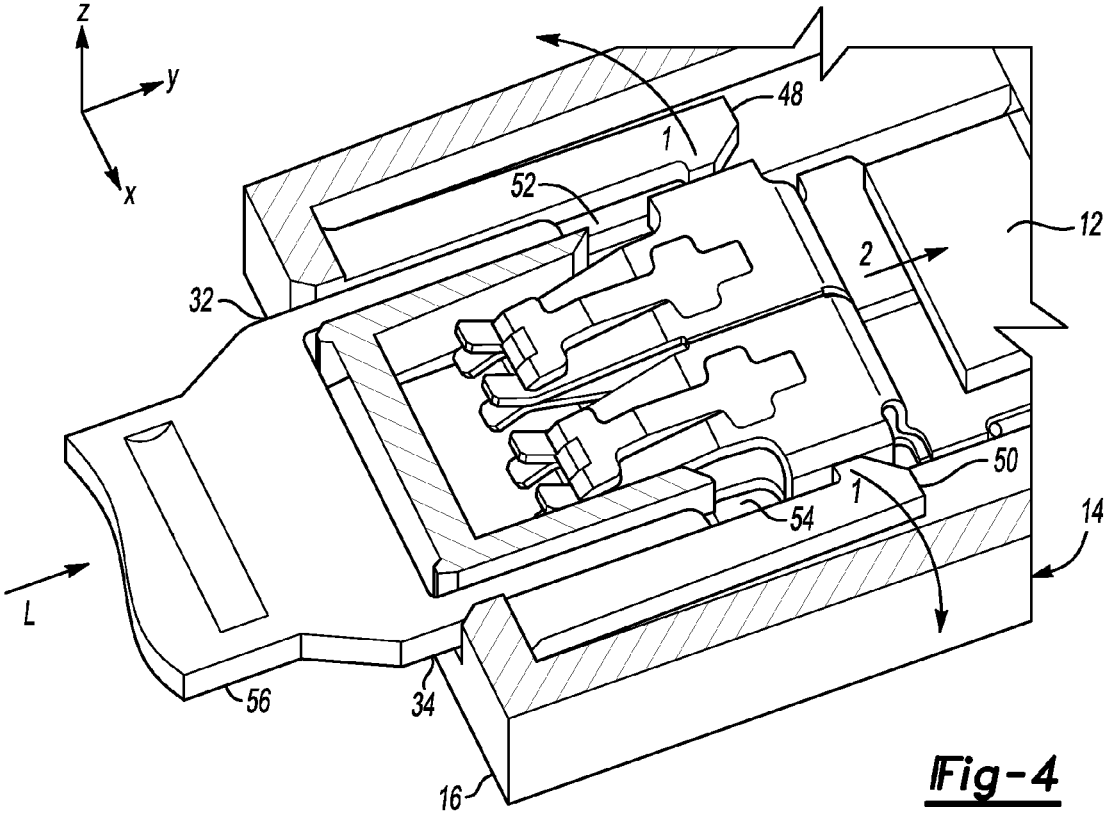
FIG. 4 is a partial cross-sectional view of the electrical connector shown in FIG. 3 with a removal tool inserted therein.

As shown in FIG. 4, the channels 52, 54 lie in a plane parallel to the x-y plane, and the apertures 32, 34 and the channels 52, 54 generally lie along the same plane. This allows the removal tool 56 to be inserted along a line (L) in the plane of the locking beams 48, 50, such that the locking beams 48, 50 are moved from the lock position to the release position as indicated by a directional arrows 1 and 2 without having to move the removal tool 56 up and down or otherwise use it to pry the locking beams to the release position. This helps to ensure that the electrical terminal 12 can be quickly and easily removed from the housing 14, without undue effort or force.

Figure 5:
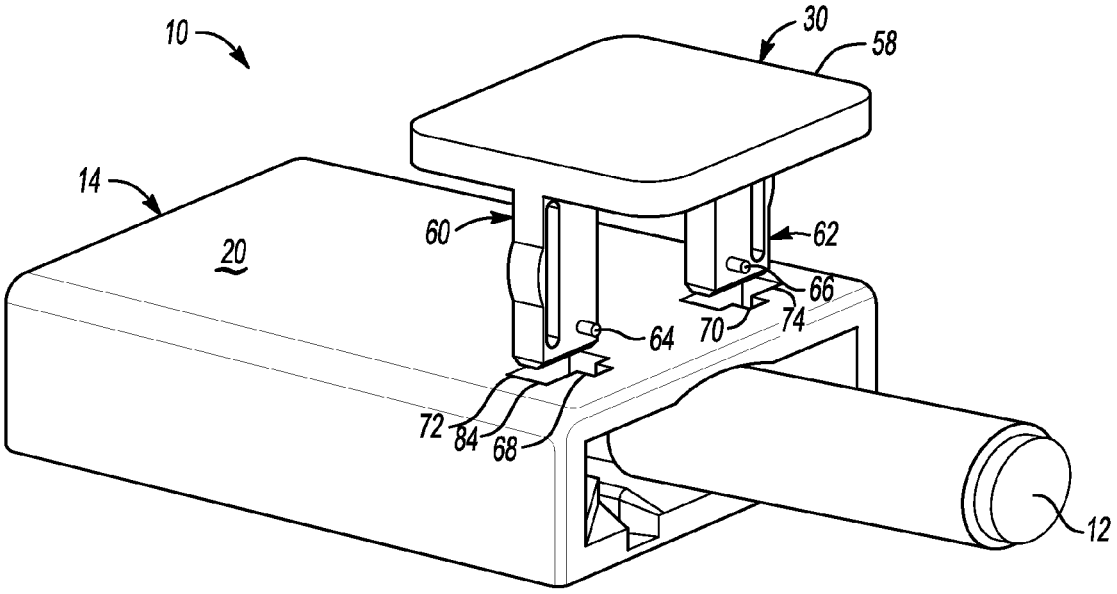
FIG. 5 is a perspective view of the electrical connector shown in FIG. 1 illustrating a locking system for the electrical terminal in the connector.

FIG. 5 shows the electrical connector 10, and in particular the relationship between the second lock system 30 and the housing 14. The second lock system 30 includes a head 58 and a pair of elongate members 60, 62 extending outwardly therefrom. In the embodiment shown in FIG. 5, the second lock system is configured with protrusions or pegs 64, 66, which are configured to align with alignment features and 68, 70, which are part of apertures 72, 74 disposed through the wall 20 of the housing 14. These features help to ensure that the second lock system 30 can be inserted into the housing 14 with only one orientation.

Figure 6:
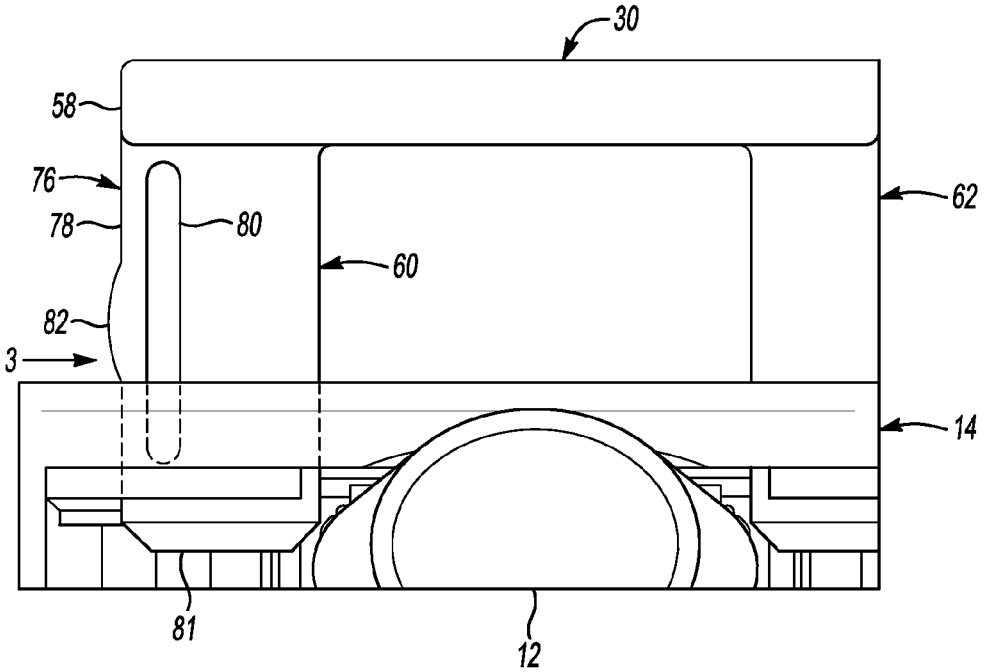
FIG. 6 is a perspective view showing details of the locking system shown in FIG. 5.

FIG. 6 shows additional details of the lock system 30, and in particular, the elongate members 60—it being understood that the elongate member 62 has corresponding features. As shown in FIG. 6, the lock system 30 is in a first, or pre-lock position in which the elongate members 60, 62 are partially inserted into the housing 14, and in particular, partially disposed within the apertures 72, 74 of the housing 14. In this position, the lock system 30 will generally be retained by the housing 14, but because it is not fully inserted, the lock system 30 does not obstruct insertion of the electrical terminal 12 into the housing 14. In at least some embodiments, a lock system, such as the lock system 30, can be configured to help guide an electrical terminal into a corresponding housing.

The elongate member 60 includes a flexible beam 76, which is bounded by an edge 78 of the elongate member 60 and a through-slot 80 that is disposed through the elongate member 60 in a lengthwise direction generally parallel to the edge 78. As shown by the hidden lines in FIG. 6, the slot 80 is fully contained within the elongate member 60; however, it could be formed such that it is open to an end 81 of the elongate member 60. In such a case, the flexible beam that is formed would be cantilevered, rather than supported on both ends such as the flexible beam 76 shown in FIG. 6. A convex portion of the flexible beam 78 forms a lock feature 82 extending outwardly from the edge 78 as shown in FIG. 6.

Figure 7:
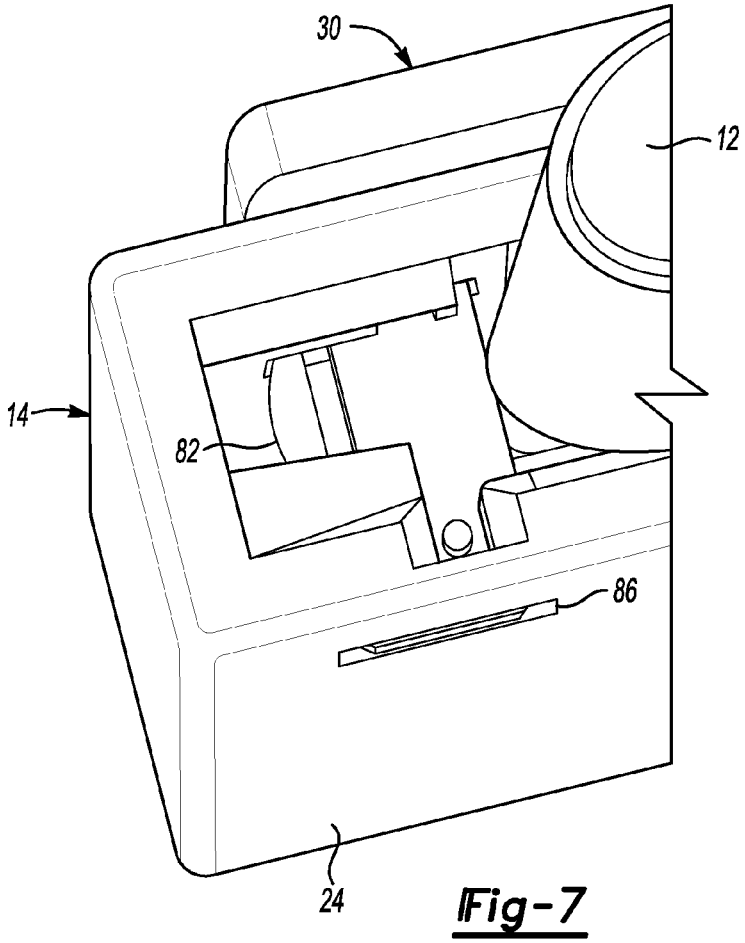
FIG. 7 is a fragmentary view showing further details of the locking system shown in FIG. 5.

The lock feature 82 is sized such that as the lock system 30 is inserted into the housing 14, the lock feature 82 contacts an edge 84 (see FIG. 5) of the aperture 72. This forces the flexible beam 76 from a first position as shown in FIG. 6 inward toward the slot 80 into a second position as indicated by the directional arrow 3, and allows the lock system 30 to be fully inserted into the housing 14. FIG. 7 shows the lock system 30 in a second position—i.e., a lock position—after it has been fully inserted into the housing 14. In particular, it is shown that the lock feature 82 is now inside the housing 14, and the flexible beam 76 has returned to the first position. It is understood that manufacturing components that interact with each other necessarily include some imprecision as a result of tolerance stack up and other manufacturing considerations. Thus, the lock feature 82 is said to be disposed within the housing 14, even though a small portion of it may still reside within the aperture 72.

In the embodiment shown in FIGS. 6 and 7, the lock feature 82 is generally symmetrical along a length of the elongate member 60. Moreover, as discussed above, after insertion of the lock system 30 into the housing 14, the lock feature 82 is at least substantially disposed within the housing 14. These features provide the advantage of having the lock system 30 require approximately the same insertion force into the housing 14 as extraction force when it is removed from the housing 14.

Figure 8:
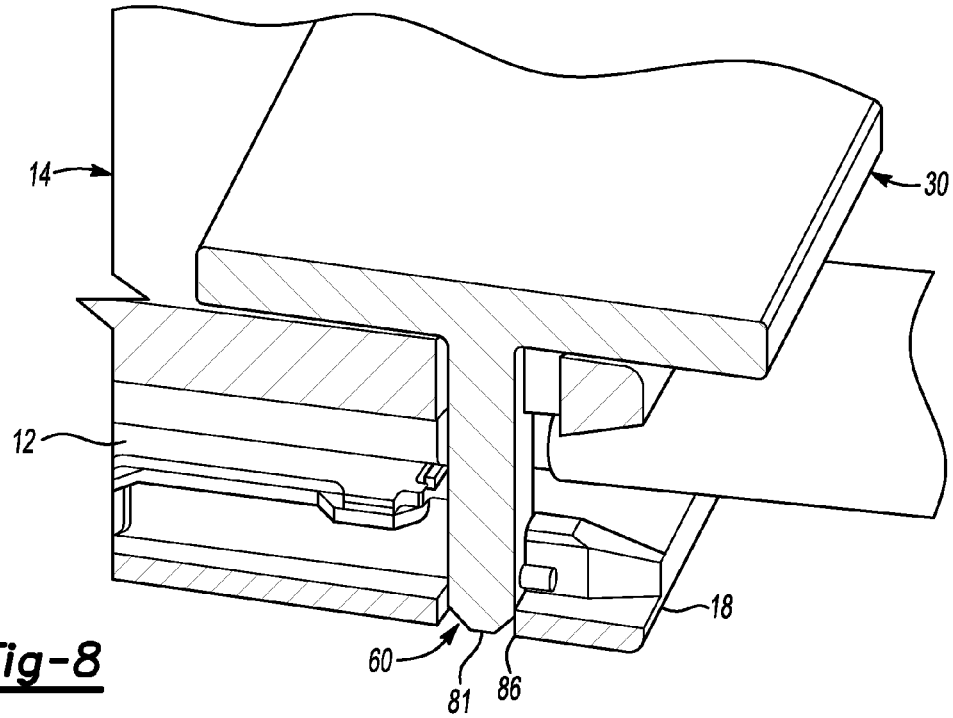
FIG. 8 is a partial cross-sectional view of the locking system shown in FIG. 5 inserted into a housing of the electrical connector.

Also shown in FIG. 7, is an aperture 86 disposed in the wall 24 of the housing 14. The aperture 86 is generally aligned with the aperture 72, to allow the elongate member 60 to enter into the aperture 86 when the lock system 30 is inserted into the housing 14. This helps to provide a more secure retention by requiring greater extraction force to remove the electrical terminal 12 from the housing 14. This is further illustrated in FIG. 8, where the end 81 of the elongate member 60 is shown within the aperture 86. As shown in FIG. 8, with the lock system 30 fully inserted into the housing 14, the elongate member 60 is disposed between the terminal 12 and the back end 18 of the housing 14. Thus, if the first lock system 28 fails, the second lock system 30 acts as a blocking member to keep the electrical terminal 12 within the housing 14. In order to remove the electrical terminal 12 from the housing 14, the lock system 30 can be pulled outward to the pre-lock position—see FIG. 6—and the first lock system 28 can be released as described above.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrical connector, comprising:

an electrical terminal;

a housing having a front end and a back end having an opening configured to receive the electrical terminal therethrough, the housing including a first lock system configured to allow insertion of the electrical terminal into the housing and prohibit removal of the electrical terminal therefrom, the housing being configured such that the first lock system is accessible from the front of the housing to release the electrical terminal from the first lock system; and a second lock system configured for insertion into the housing to prohibit removal of the electrical terminal from the housing independently from the first lock system, the second lock system including at least one elongate member having a respective convex portion extending outwardly therefrom and configured to cooperate with the housing such that an insertion force required to insert the second lock system into the housing is substantially the same as an extraction force required to extract the second lock system from the housing without independently deflecting the convex portion to facilitate the extraction.

2. The electrical connector of claim 1, wherein the housing includes a housing alignment feature and the electrical terminal includes a terminal alignment feature configured to cooperate with the housing alignment feature such that the electrical terminal is insertable in the housing with only one orientation.

3. The electrical connector of claim 1, wherein the housing includes a plurality of walls and a pair of apertures disposed through at least one of the walls, the second lock system including a pair of the elongate members extending from a head, each of the elongate members being configured for insertion into a respective one of the apertures such that the elongate members are disposed between the electrical terminal and the opening in the back end of the housing.

4. The electrical connector of claim 3, wherein each of the elongate members includes a protrusion extending therefrom, each of the apertures being configured to receive a respective protrusion in only one orientation.

5. The electrical connector of claim 3, wherein each of the elongate members includes a respective flexible beam configured to deflect from a first position to a second position during insertion into a respective one of the apertures and to return substantially to the first position after insertion.

6. The electrical connector of claim 5, wherein each of the elongate members includes a respective edge having a respective slot disposed generally parallel thereto through the respective elongate member such that each of the flexible beams is bounded by a respective one of the edges and a respective one of the slots.

7. The electrical connector of claim 5, wherein the respective convex portion of each of the flexible beams is sized to contact an edge of a respective one of the apertures in the housing during insertion therein, the convex portions being substantially symmetrical along a length of the flexible beams.

8. The electrical connector of claim 1, wherein the first lock system includes a pair of horizontally actuating cantilevered beams movable from a lock position to a release position, the front of the housing including a pair of apertures each disposed proximate a respective one of the cantilevered beams to allow access to the cantilevered beams for moving the cantilevered beams from the lock position to the release position.

9. The electrical connector of claim 8, wherein the apertures in the front of the housing are generally aligned with a plane containing the cantilevered beams such that the cantilevered beams are movable from the lock position to the release position by insertion of a removal tool through the apertures along a line in the plane of the cantilevered beams.

10. An electrical connector, comprising:

an electrical terminal;

a housing including:

a front end, a back end including an opening therein for facilitating insertion of the electrical terminal into the housing such that the housing at least partially encloses the electrical terminal, a plurality of walls, a pair of locking beams having a lock position for prohibiting removal of the electrical terminal from the housing and a release position for facilitating removal of the electrical terminal from the housing, and a pair of channels accessible through the front end and arranged such that a respective one of the locking beams extends into each of the channels such that a removal tool inserted into the channels contacts the beams to automatically move the locking beams from the lock position to the release position; and a blocking member configured for insertion into the housing to block removal of the electrical terminal from the housing, the blocking member including a head and an elongate member extending outwardly therefrom, at least one of the walls of the housing including an aperture disposed therein proximate the back end to receive the elongate member therein such that the elongate member is disposed between the electrical terminal and the opening in the back end, and wherein the elongate member includes: a flexible beam configured to deflect from a first position to a second position during insertion into the aperture and to return substantially to the first position after insertion, and an edge having a through-slot disposed generally parallel thereto such that the flexible beam is bounded by the edge and the slot.

11. The electrical connector of claim 10, wherein the blocking member is configured to cooperate with the housing: in the first position wherein the blocking member is partially disposed within the housing and the electrical terminal is insertable into and removable from the housing, and in the second position wherein the blocking member is fully inserted into the housing to block removal of the electrical terminal from the housing.

12. The electrical connector of claim 10, wherein the flexible beam includes a lock feature configured to contact an edge of the aperture during insertion therein, thereby causing the flexible beam to deflect from the first position to the second position, the lock feature being positioned on the elongate member such the lock feature is within the housing after insertion.

13. The electrical connector of claim 10, wherein the channels in the housing are generally aligned with a plane containing the locking beams such that the locking beams are movable from the lock position to the release position by insertion of a removal tool in the channels along a line in the plane of the locking beams.

14. An electrical connector, comprising:

an electrical terminal;

a housing configured to at least partially enclose the electrical terminal, the housing including a pair of locking beams, each having a cantilever attachment directed toward a front of the housing and disposed on opposite sides of the electrical terminal, the locking beams having a lock position in which the locking beams are engaged with the electrical terminal and a release position in which the locking beams are not engaged with the electrical terminal, the housing including a back end through which the electrical terminal is inserted into the housing, and a front end through which a mating terminal can be inserted to mate with the electrical terminal, the front end including a pair of apertures generally aligned with the locking beams for receiving a removal tool to move the locking beams from the lock position to the release position; and a lock system configured for insertion into the housing such that a portion of the lock system is disposed between the electrical terminal and the back end, thereby prohibiting removal of the electrical terminal from the back end, the lock system including a pair of elongate members extending from a head, the housing being generally rectangular and defined by four walls and the front and back ends, at least one of the walls having a pair of apertures, each configured to receive a respective one of the elongate members such that the elongate members are positionable between the electrical terminal and the back end of the housing.

15. The electrical connector of claim 14, wherein each of the elongate members includes a respective slot disposed therethrough in a lengthwise direction, thereby forming a respective flexible beam in each of the elongate members.

16. The electrical connector of claim 15, wherein each of the flexible beams includes a respective convex portion extending outwardly therefrom and sized to contact an edge of a respective one of the apertures in the housing during insertion therein, the convex portions being substantially symmetrical along a length of the flexible beams, such that an insertion force required to insert the lock system into the housing is substantially the same as an extraction force required to extract the lock system from the housing.

* * * * *